United States Patent [19]

Casper et al.

[11] 4,276,733

[45] Jul. 7, 1981

[54] METHOD OF CONSTRUCTING AND ERECTING A DOME-SHAPED STRUCTURE

[75] Inventors: William L. Casper, Lafayette; Michael A. Jordon, Oakland; Craig S. Caulkins, Pleasant Hill; Robert G. Miller, San Mateo, all of Calif.

[73] Assignee: Liftech Consultants, Inc., Oakland, Calif.

[21] Appl. No.: 60,295

[22] Filed: Jul. 25, 1979

[51] Int. Cl.[3] ..... E04B 1/32; E04G 21/00

[52] U.S. Cl. ..... 52/745; 52/80; 52/71

[58] Field of Search ..... 52/71, 80, 86, 81, 741, 52/745, 747

[56] References Cited

U.S. PATENT DOCUMENTS

| | | | |
|---|---|---|---|
| 3,417,520 | 12/1968 | Fink | 52/80 |
| 4,144,685 | 3/1979 | Fox | 52/745 |
| 4,171,600 | 10/1979 | Whitney | 52/745 |

FOREIGN PATENT DOCUMENTS

| | | | |
|---|---|---|---|
| 206160 | 11/1959 | Austria | 52/80 |
| 2605542 | 8/1976 | Fed. Rep. of Germany | 52/80 |
| 1183193 | 3/1970 | United Kingdom | 52/80 |

OTHER PUBLICATIONS

Space Structures, M. N. Brainov "Montierbare, Transportable, Leichte Kuppelkonstruktionen" Chapter 87 relied upon Sep. 1966.

Engineering News Record pp. 34–35 relied upon Nov. 16, 1978.

*Primary Examiner*—J. Karl Bell

*Attorney, Agent, or Firm*—James R. Cypher

[57] ABSTRACT

A dome-shaped structure comprising a plurality of prefabricated base panels and a plurality of upper panels hingedly connected to one another. The structure is erected by first lifting a plurality of base panels to their final position with the upper end of each upper panel remaining near ground level. The base panels are then connected together. The upper panels are then lifted to their final position and connected to a compression ring.

9 Claims, 12 Drawing Figures

METHOD OF CONSTRUCTING AND ERECTING A DOME-SHAPED STRUCTURE

BACKGROUND OF THE INVENTION

Large dome-shaped structures have been constructed by first constructing an extensive temporary internal scaffolding. The arch members and ribs are supported by internal scaffolding during construction. When the dome has been completed, the scaffolding is dismantled and removed from inside the dome structure.

Where the diameter and height of the dome constructed by these standard methods exceeds the height and reach of standard mobile cranes, it is expensive to lift the materials to the final elevation of the structure, and the workmen are required to work at extreme heights and on curved or inclined surfaces which greatly increases the danger. The cost of erecting and dismantling the huge scaffolding which not only must support the workmen but also support the dome structure during construction is exceedingly costly and has greatly inhibited the construction of these structures.

Since many of the structural members are curved and most of the joints are angularly related, it is difficult to erect such structures at the site where dimensionally accurate jigs and factory controlled conditions are impossible.

A dome having similar dimensions as the structure described in this specification was designed by the La Farge Company of Montreal, Canada. The structure was to be erected using internal scaffolding and because standard cranes could not lift the arch members as a single unit, they were to be constructed by bolting a series of straight members together at great cost due to the need for many flange connections and a great deal of labor in the assembly.

A different type dome structure is shown in Fink, U.S. Pat. No. 3,417,520 granted Dec. 24, 1968. Fink raised the individual arch members with cranes and then carried out the rest of the construction with conventional methods using either scaffolding or mobile work platforms. The arch members were not jointed nor were entire panels prefabricated on the ground.

SUMMARY OF THE INVENTION

The gist of the present invention is to divide a dome structure into several series of base panels and upper panels; prefabricate the panels in a unique manner; hinge certain base panels and upper panels together; and then lift certain series of panels in a new step-by-step sequence. The panels may be of any suitable polygonal shape and may be either planar or arcuate. The arch members may be either formed from a series of straight segments or consist of curved members. Only one form of the invention is shown and described in the specification and drawings.

Specifically, the dome structure is divided into two series of base panels hinged at their bases to a perimeter foundation by foundation hinge means. A first series of prefabricated upper panels are hinged to the first series of base panels by inter-panel hinge means. A second series of base panels are located between the first series base panels and a second series of upper panels fill the spaces between the first series of upper panels.

The first step in erecting the dome is to individually lift the first series of base panels with their respective hingedly attached first series upper panels. The first series base panels are lifted to their final position, but only the base of each of the first series upper panels are lifted. The nose of the upper panel remains only slightly elevated above the ground. All of the first series base panels are then connected together at their upper portions forming a temporary compression ring to form a free standing structure.

The second step is to lift the second series of base panels to their final position and attach them to the first series of base panels.

The next step is to lift the first series of upper panels; pivoting them about the inter-panel hinge points and connecting them to a compression ring at the top of the dome.

Finally, the remaining second series upper panels and other base panels are filled in by conventional construction methods.

No internal or external scaffolding is required at any time during the construction of the dome.

The panels may be prefabricated with or without the roofing member which may consist of corrugated metal members. Where wind conditions are favorable, it is preferable to cover the panels with the roofing members so that the work of attaching the corrugated roofing members after the panels have been lifted can be minimized.

DESCRIPTION OF THE PREFERRED METHOD AND CONSTRUCTION

The method of constructing and erecting a dome-shaped structure disclosed herein was successfully used in constructing and erecting a building in California with a diameter of approximately 312 feet and a height of approximately 90 feet. The curvature of the dome measured approximately 230 feet in radius. These dimensions are by no means critical and are recited herein only to indicate the magnitude of the project.

Figure 1:
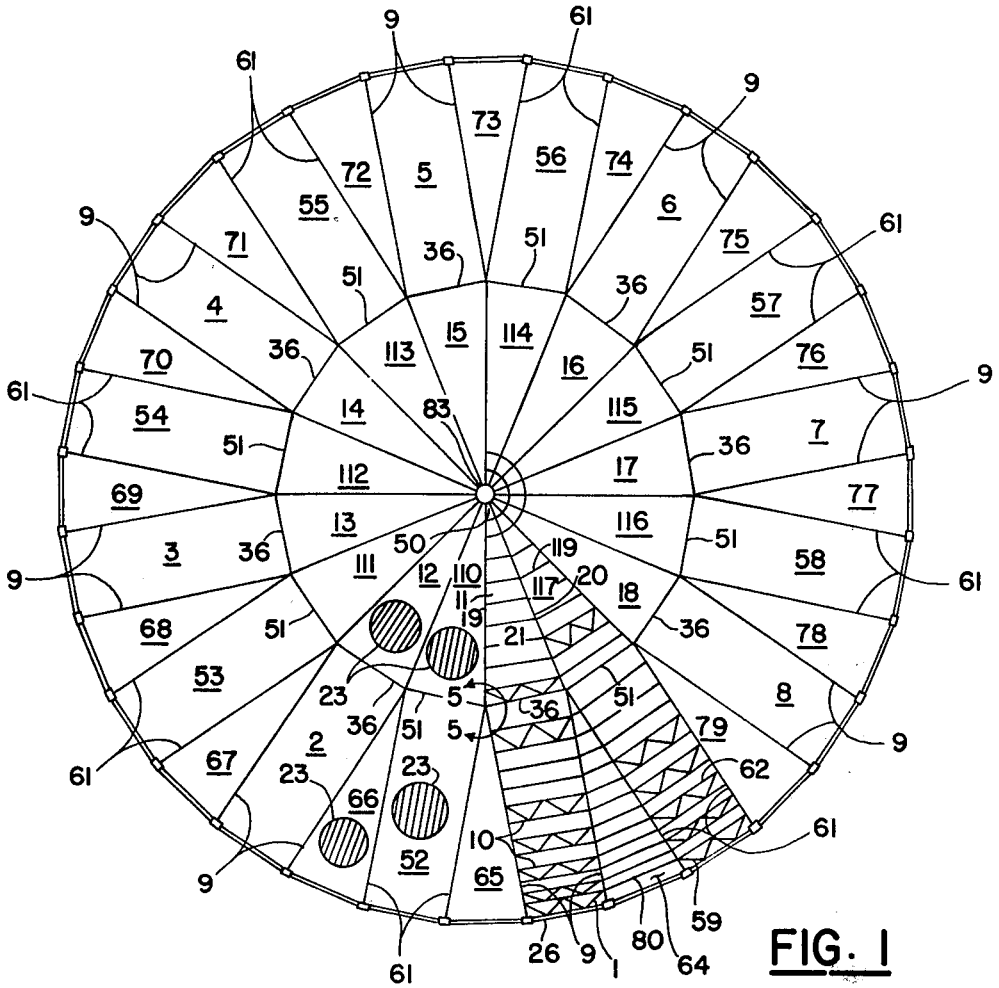
FIG. 1 is a schematic plan view of the dome-shaped structure of the present invention.

As shown in FIG. 1, the dome is divided into eight identical first series arcuate-shaped rectangular base panels which are numbered 1–8. The first series rectangular base panels constitute every other rectangular panel. Each panel was prefabricated at a factory installation and sections which were too large to transport were assembled at the site. The rectangular panels are constructed from curved arch members 9 and straight rib members 10. The rib members 10 are typical of all of the rectangular members and are not repeated in the drawing.

Eight identical first series arcuate-shaped triangular upper panels which are numbered 11–18 are prefabricated and assembled on the ground and hingedly attached to the first series rectangular base panels. Each triangular panel is constructed in an identical manner with arch members 19 and 20 and rib member 21. The rib members are not repeated in the drawing.

Corrugated sheet metal decking indicated by the number 23 covers the entire structure and is attached to the rib members by sheet metal screws. The corrugated sheet metal decking is attached to the first series rectangular members on the ground. Several sheets of corrugated decking are attached to the first series triangular members on the ground.

At the lower end 26 of each rectangular panel each arch member 9 is preferably formed with a flange 27 formed with an opening 28 constituting a second portion of a foundation hinge means for receiving a pin 29 therethrough. The pin 29 is connected to flanges 31 and 32 of an arch shoe 33 which form the first portion of the foundation hinge means. The arch shoe is connected to foundation pier 34 by bolts 35. The arch shoe and pin serve as a permanent thrust connection and as a part of the erecting procedure as will be described.

Figure 5:
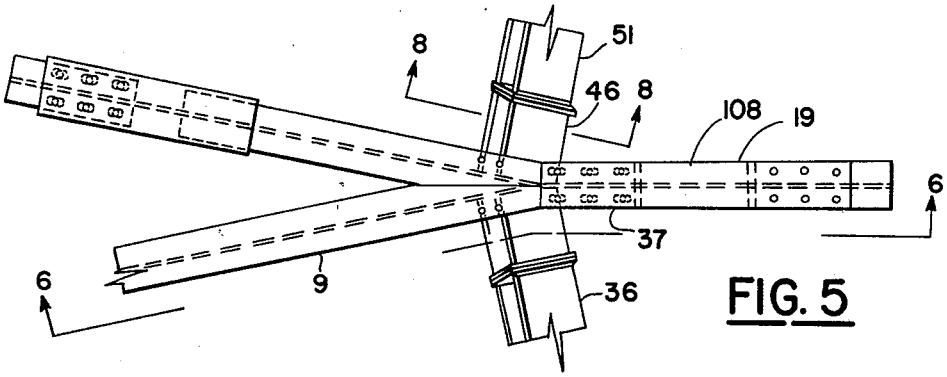
FIG. 5 is a top plan view of a portion of the structure in the area of line 5—5 of FIG. 1.
Figure 6:
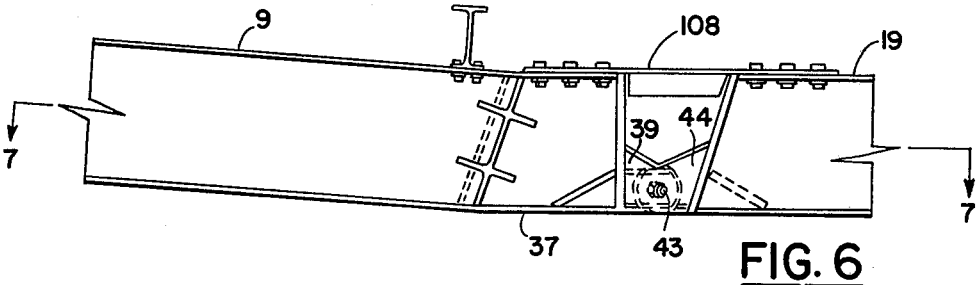
FIG. 6 is a side elevation view taken along line 6—6 of FIG. 5.
Figure 7:
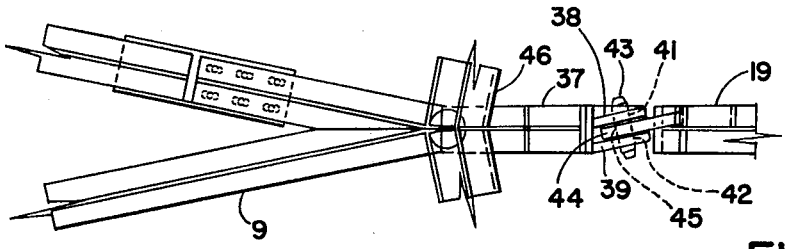
FIG. 7 is a sectional view taken along line 7—7 of FIG. 6.
Figure 8:
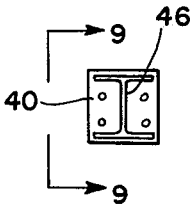
FIG. 8 is a cross sectional view of the mid-compression member taken along line 8—8 of FIG. 5.
Figure 9:
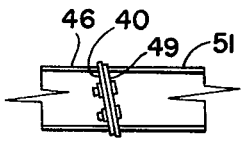
FIG. 9 is a side view of the member shown in FIG. 8.

An inter-panel hinge means for pivotally connecting each of the first series rectangular base members to the first series triangular upper panels is shown in detail in FIGS. 5–7. Each of the first series rectangular members is constructed with a strut 36 which, after completion of the first phase of construction, serves as a mid-compression ring. A stub member 37 is connected to the arch member 9 and is formed with flanges 38 and 39 formed with openings 41 and 42 constituting the first portion of the inter-panel hinge means for receiving pin 43 therethrough. Arch members 19 and 20 are formed with a flange 44 having an opening 45 constituting the second portion of the inter-panel hinge means for receiving pin 43.

Figure 2:
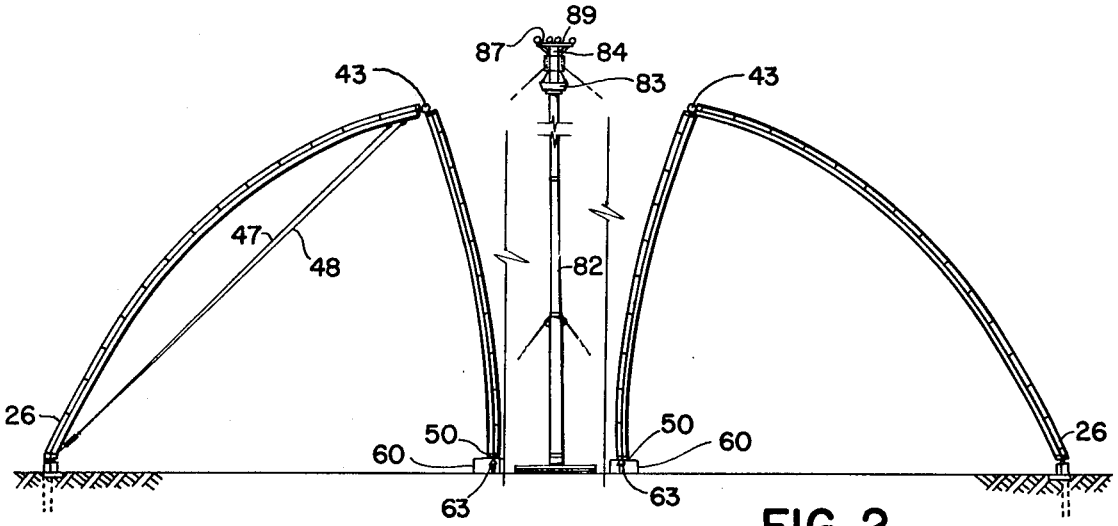
FIG. 2 is a side elevation view of two panels in the partially erected position. A construction lifting device is shown at the center of the dome. The panels have been moved together in the drawing so that both panels could be illustrated.

The procedure for the first stage of erection of the dome is as follows: Prior to lifting, each of the first series rectangular panels 1–8 are connected to the foundation by the foundation hinge means above described. Cross cable tie members 47 and 48 are connected to the diagonal corners of the rectangular panels prior to lifting as shown in FIG. 2 to give the panel structural stability for lifting and to impose the proper curvature to the panel. A first series triangular upper panel is hingedly connected to each of the first series rectangular panels and the assembly is ready for lifting.

Two mobile construction cranes are positioned on either side of a first series rectangular panel and lines are attached to the corners of the upper ends of the rectangular panels. An alternate rigging procedure is to connect the crane lines to ends of a lifting cross bar and attach the upper corners of the panel to opposite ends of a line which passes through a sheave attached to the lifting cross bar. As the rectangular member is raised, the nose 50 of the triangular member slides along the ground towards the foundation of the dome. When the final elevation of the rectangular member is reached, the nose of the triangular panel has lifted off the ground. The nose is then supported temporarily on a temporary vertical support 60 and also temporarily tied to ground anchor 63 to prevent any upward lift imposed by wind loads against the rectangular panel. When the nose of the triangular panel is sufficiently secured, the crane lines are removed and the mobile cranes are moved to opposite sides of the next rectangular panel to be lifted.

It is not important which panel is to be lifted next. Any of the eight first series panels may be lifted in any sequence since each rectangular panel is independently supported by its attached triangular panel resting on its nose 50. It is preferable to lift adjacent first series panels and then connect them with a strut member 51 to give the panels lateral stability against high wind forces. The flange 40 on strut stub 46 is placed at an angle for ease in connecting angled flange 49 on strut 51.

Figure 3:
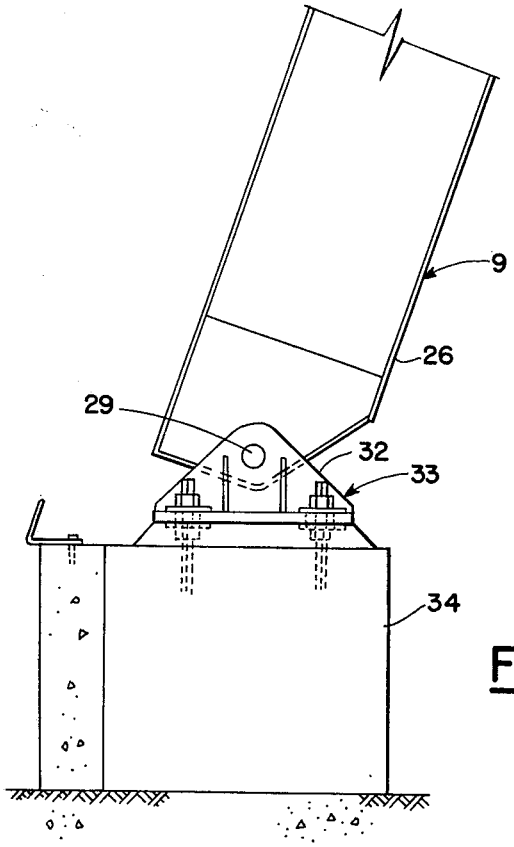
FIG. 3 is a side elevation view of a portion of the foundation and the support member for one of the arch members.
Figure 4:
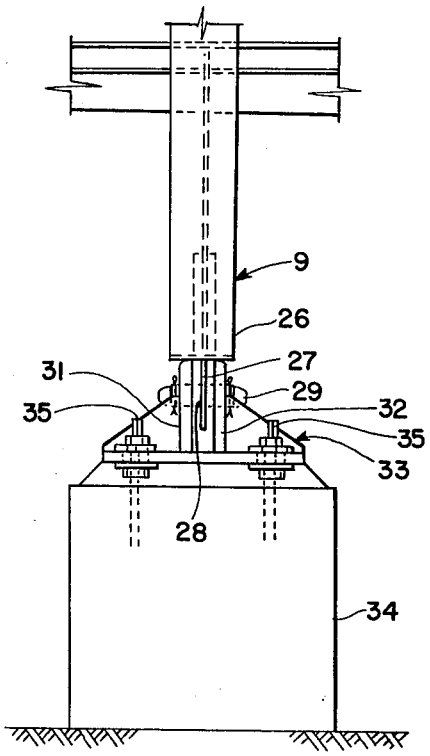
FIG. 4 is a front elevation view of the structure shown in FIG. 3.

The next preferred step is to raise the intervening second series arcuate rectangular base panels 52–59. These panels are connected to the foundation in the same manner as the first series panels with foundation hinge means illustrated in FIGS. 3 and 4. Mobile cranes may be used to lift the panels to their final positions in the same manner as previously described. No triangular panels are attached to the second series panels during the lifting step. The second series rectangular panels are formed from arch members 61 and rib members 62.

The lower triangular panels 64–79 are then preferably filled in with ribs 80. This completes the lower portion of the dome which now has structural stability and can now support the raising of the upper triangular panels.

Figure 10:
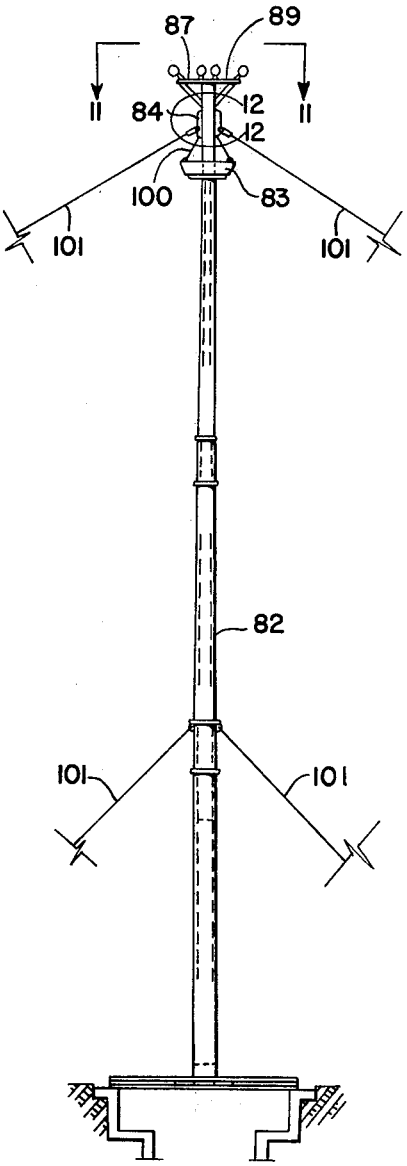
FIG. 10 is a side elevation view of a construction pole used in elevating the upper triangular panel members.
Figure 12:
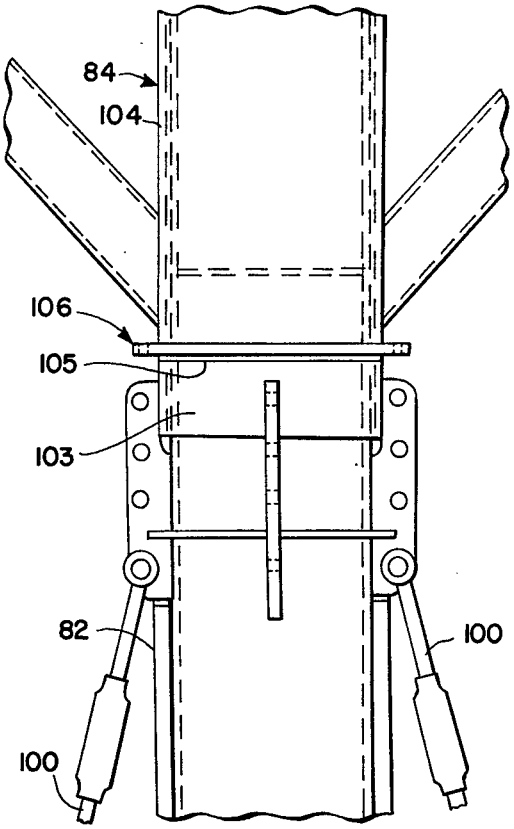
FIG. 12 is an enlarged side view of a portion of the tower shown generally in the vicinity of the lines 11—11 on FIG. 10.
Figure 11:
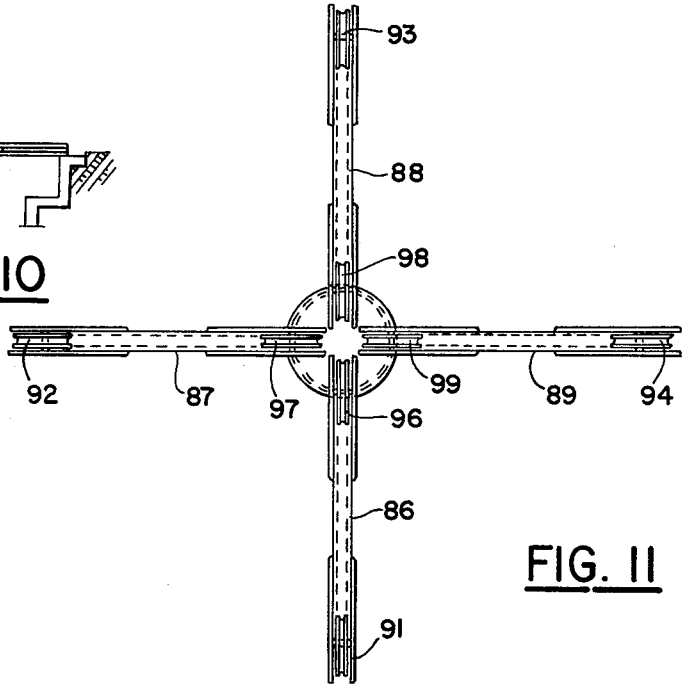
FIG. 11 is a plan view of a portion of the tower shown in FIG. 10 and taken along line 11—11.

One of the preferred methods of raising the upper triangular panels is with a construction pole as illustrated in FIGS. 2, 10, 11 and 12. The construction pole consists of an elongated pole member 82 dimensioned to rise above the uppermost portion of the dome and to extend through the compression ring 83. A head member 84 is rotatably connected to the top of the pole member. A plurality of arms carrying sheaves may be connected to the head. As one example, four arms 86–89 are geometrically spaced 90 degrees from one another and extend laterally from the top of the pole. Four sheaves 91–94 are connected to the arms. Four internal sheaves 96–99 are rotatably attached to the inner portions of the arms. Cables 100 attached to the pole hold compression ring 83 as shown in FIG. 10. Guy wires 101 stablize the construction pole. The head member is constructed with a collar 103 welded to the pole member 82. An outer pipe 104 rests on upper edge 105 of the collar. A turning ring 106 formed with spaced openings enables the rotatable head to be moved by a pry bar.

With the construction pole in place, cables are placed over the four sheaves and attached to four of the first series upper triangular panels at the nose sections of the triangles. The panels to be lifted should be 90 degrees apart for balance. When the four upper panels are lifted to their final positions, they are attached to the compression ring 83. Preferably the inter-panel hinge means is rigidified by bolting plates 108 as illustrated in FIG. 6 to the arch stub member 37 and to arch member 19. Thus each of the base rectangular first series panels forms a unitary structure with its corresponding triangular upper panel.

The construction pole head is then rotated and four more triangular upper panels are raised to their final position as set forth above. The noses of the triangles are attached to the compression ring 83 and plates 108 are bolted to the arch members.

The structure is completed by fillling in the remaining upper second series arcuate triangles 110–117 with cross sectional rib members 119.

The construction pole is dismantled and removed from the structure. The corrugated sheet metal is placed over the entire structure and the dome is complete.

An alternate erection method is to use mobile cranes instead of a construction pole for lifting the first series triangular upper sections. The compression ring 83 is attached to one of the noses of the upper triangle panels. A crane lifts this panel to its final position. The triangular panel is connected to the rectangular panel that it is hingedly connected to by bolting plate 108 in place as previously described.

Another triangular panel opposite the first panel is then lifted to its final position and bolted to the compression ring. The triangular panel is then connected to the rectangular panel by bolting on the 108 plate as previously described. To prevent distortion of the compression ring, the weight of the first two first series triangular panels should be bourne by one of the cranes while the third and fourth triangular panels are individually lifted by the second mobile crane. After the first four triangular panels are connected to their respective rectangular panels by plates 108 and to the compression ring, the remaining four triangular panels of the first series type panels can be lifted to their final positions. The remaining triangular panels are then filled in and the corrugated sheet roofing secured as previously described.

We claim:

1. A method of constructing and erecting a dome-shaped structure without temporary internal roof high scaffolding comprising the steps of:

a. installing a foundation including a first portion of a foundation hinge means;

b. pre-fabricating a plurality of base panels having lower ends and upper ends and having the first portion of an inter-panel hinge means at said upper ends and including generally horizontal strut members at said upper ends;

c. fabricating said base panels with a second portion of said foundation hinge means at said lower ends;

d. pivotally attaching said lower ends of said base panels to said foundation at said foundation hinge means;

e. pre-fabricating a plurality of upper panels having lower ends and upper ends and having the second portion of said inter-panel hinge means at said lower ends;

f. hingedly connecting said lower ends of each of said upper panels to said upper ends of each of said base panels;

g. pivotally lifting in a one at a time sequence each of said base panels to their final position and simultaneously raising the lower ends of said upper panels while said upper ends of said upper panels slide away from the center of said dome and remain at a lower elevation to temporarily shore said base panels;

h. connecting said strut of each of said base panels forming a temporary mid-compression ring at the upper ends of said base panels causing said base members to form a free standing immovable structure;

i. pivotally and sequentially lifting diametrically opposed pairs of said upper panels to their final positions about said inter-panel hinge means;

j. attaching said upper ends of said upper panels to one another; and k. securing each of said base panels to said upper panels to rigidify said inter-panel hinge means forming a plurality of unitary acting upper panels and lower panels.

2. A method as described in claim 1 comprising:

a. prefabricating said base panels in a generally rectangular arcuate shape; and b. prefabricating said upper panels in a generally triangular arcuate shape.

3. A method as described in claim 1 comprising:

a. lifting said lower panels to said final position with mobile cranes; and b. lifting said upper panels with a construction pole placed at the center of the dome structure.

4. A method as described in claim 3 comprising:

a. fabricating said construction pole with a rotatable head.

5. A dome structure comprising:

a. a foundation including a first portion of a foundation hinge means;

b. a plurality of base panels having lower ends and upper ends including a second portion of a foundation hinge means mounted on said lower end and hingedly connected to said foundation;

c. a plurality of upper panels having lower ends and upper ends;

d. inter-panel hinge means pivotally connecting each of said base panels to each of said upper panels;

e. a mid-compression ring connecting all of said upper ends of said base panels; and f. an upper compression ring connected to each of said upper ends of said upper panels.

6. A dome structure as described in claim 5 comprising:

a. said base panels have a generally rectangular arcuate shape; and b. said upper panels have a generally triangular arcuate shape.

7. A construction pole for erecting a dome-shaped structure formed with a compression ring comprising a plurality of prefabricated lower panels and prefabricated upper panels hingedly connected to one another comprising:

a. an elongated pole member dimensioned to rise above the upper most portion of said dome and to extend through said compression ring;

b. a head member rotatably connected to the top of said pole member;

c. a plurality of geometrically spaced arms connected to said head member extending laterally from the top of said pole member; and d. a plurality of sheaves attached to the ends of said arms.

8. A construction pole as described in claim 7 comprising:

a. said head member is formed with four arms spaced 90 degrees from one another.

9. A method of constructing and erecting a dome-shaped structure without temporary internal roof high scaffolding comprising the steps of:

a. installing a foundation including a first portion of a foundation hinge means;

b. pre-fabricating a plurality of first series base panels having lower ends and upper ends and having the first portion of an inter-panel hinge means at said upper ends and including generally horizontal first series strut members at said upper ends;

c. fabricating said first series base panels with a second portion of said foundation hinge means at said lower ends;

d. pivotally attaching said lower ends of said first series base panels to said foundation at said foundation hinge means;

e. pre-fabricating a plurality of first series upper panels having lower ends and upper ends and having the second portion of said inter-panel hinge means at said lower ends;

f. hingedly connecting said lower ends of each of said first series upper panels to said upper ends of each of said first series base panels;

g. lifting in a one at a time sequence said first series base panels to their final position and simultaneously raising the lower ends of said first series upper panels while said upper ends of said first series upper panels remain at a lower elevation to temporarily shore said first series base panels;

h. inserting a second series of strut members between the upper ends of each of said first series base panels and connecting said second series strut members to said first series strut members forming a temporary mid-compression ring at the upper ends of said first series base panels causing said first series base members to form a free standing immovable structure;

i. prefabricating a plurality of second series base panels between said first series base panels with each panel having lower ends formed with a foundation hinge means and upper ends formed with strut connecting means;

j. pivotally attaching said lower ends of said second series base panels to said foundation at said foundation hinge means;

k. pivotally lifting in a one at a time sequence each of said second series base panels to their final position and connecting said upper ends to said second series strut members;

l. pivotally and sequentially lifting diametrically opposed pairs of said upper panels to their final positions about said inter-panel hinge means;

m. attaching said upper ends of said upper panels to one another; and n. securing each of said base panels to said upper panels to rigidify said hinge means forming a plurality of unitary acting upper panels and lower panels.

* * * * *